US010349482B2

(12) United States Patent
Khare et al.

(10) Patent No.: US 10,349,482 B2
(45) **Date of Patent: *Jul. 9, 2019**

(54) SYSTEM AND METHOD TO REGULATE PRIMARY SIDE CURRENT USING AN EVENT DRIVEN ARCHITECTURE IN LED CIRCUIT

(71) Applicant: GLOBALFOUNDRIES INC., Grand Cayman (KY)

(72) Inventors: Abhisek Khare, Bangalore (IN); Somnath Samantha, Bangalore (IN); Krishnadas Bhagwat, Bangalore (IN); Sumon K Bose, Bangalore (IN); Hrishikesh Bhagwat, Bangalore (IN); Rajesh Swaminathan, Bangalore (IN); Ramesh G Karpur, Bangalore (IN)

(73) Assignee: GLOBALFOUNDRIES Inc., Grand Cayman (KY)

( * ) Notice: Subject to any disclaimer, the term of this patent is extended or adjusted under 35 U.S.C. 154(b) by 19 days.

This patent is subject to a terminal disclaimer.

(21) Appl. No.: 15/531,460

(22) PCT Filed: Nov. 29, 2015

(86) PCT No.: PCT/IB2015/059192

§ 371 (c)(1),
(2) Date: May 29, 2017

(87) PCT Pub. No.: WO2016/084053

PCT Pub. Date: Jun. 2, 2016

(65) Prior Publication Data

US 2018/0295692 A1 Oct. 11, 2018

(30) Foreign Application Priority Data

Nov. 29, 2014 (IN) ..... 5988/CHE/2014

(51) Int. Cl.
*H05B 37/02* (2006.01)
*H05B 33/08* (2006.01)

(52) U.S. Cl.
CPC ..... *H05B 33/0851* (2013.01); *H05B 33/0818* (2013.01); *H05B 33/0815* (2013.01); *H05B 33/0845* (2013.01)

(58) Field of Classification Search
CPC ..... H05B 33/0815; H05B 33/0845
(Continued)

(56) References Cited

U.S. PATENT DOCUMENTS 5,949,229 A 9/1999 Choi et al.
7,102,902 B1 9/2006 Brown et al.
(Continued)

*Primary Examiner* — Thuy V Tran
(74) *Attorney, Agent, or Firm* — Thompson Hine LLP

(57) ABSTRACT

The present invention discloses system and method to regulate primary side current using an event driven architecture in LED circuit. The system (100) performs a primary side regulation (PSR) of isolated or non-isolated LED driver topology such as fly back system. The primary side peak voltage or current is regulated to achieve desired secondary side currents without the need of additional external components. The architecture combines firmware and hardware to realize PSR. The method (200) effectively combines input wave shaping (Active PFC), dimming and PSR to achieve accurate secondary side currents. The method (200) corrects the Peak Regulation Voltage or current (PRV) of primary loop to meet desired half cycle reference voltage or current, which in turn achieves the desired secondary loop current in LED circuit.

10 Claims, 5 Drawing Sheets

(58) Field of Classification Search
USPC ..... 315/291
See application file for complete search history.

(56) References Cited

U.S. PATENT DOCUMENTS

| | | | | |
|---|---|---|---|---|
| 7,733,678 | B1 | 6/2010 | Notohamiprodjo et al. | |
| 8,018,171 | B1 | 9/2011 | Melanson et al. | |
| 8,395,329 | B2 | 3/2013 | Jutras et al. | |
| 8,896,231 | B2 | 11/2014 | Brandt | |
| 8,975,826 | B1 | 3/2015 | Stevens | |
| 9,083,242 | B2 * | 7/2015 | Barnett | H02M 3/285 |
| 2007/0182387 | A1 | 8/2007 | Weirich | |
| 2008/0018261 | A1 | 1/2008 | Kastner | |
| 2008/0224629 | A1 | 9/2008 | Melanson | |
| 2009/0184695 | A1 | 7/2009 | Mocarski | |
| 2010/0117450 | A1 | 5/2010 | Azrai et al. | |
| 2011/0012530 | A1 | 1/2011 | Zheng et al. | |
| 2011/0031943 | A1 | 2/2011 | Green | |
| 2011/0068713 | A1 * | 3/2011 | Hoogzaad | H05B 33/0815 315/307 |
| 2011/0215736 | A1 | 9/2011 | Horbst et al. | |
| 2012/0098463 | A1 | 4/2012 | Stamm et al. | |
| 2012/0153858 | A1 | 6/2012 | Melanson et al. | |
| 2013/0141012 | A1 | 6/2013 | Van Laanen et al. | |
| 2013/0342122 | A1 | 12/2013 | Sawada | |

* cited by examiner

SYSTEM AND METHOD TO REGULATE PRIMARY SIDE CURRENT USING AN EVENT DRIVEN ARCHITECTURE IN LED CIRCUIT

TECHNICAL FIELD OF THE INVENTION

The present invention relates to a system to achieve accurate primary side regulation (PSR), Power Factor Correction (PFC), dimming functionality without the need of external components. More particularly, the present invention relates to a method that corrects the PRV or current of primary loop to meet desired half cycle reference voltage or current, which in turn achieves the desired secondary loop currents in LED circuit.

BACKGROUND OF THE INVENTION

LEDs are current-driven devices. LEDs are used in a various kinds of electronic applications such as architectural lighting, automotive head and tail lights, backlights for liquid crystal display devices including personal computers and high definition TVs, flashlights, etc. A LED driver circuit generally requires a constant direct current (DC), which is fed to a LED load. The LEDs have significant advantages such as high efficiency, good directionality, color stability, high reliability, long life time, small size, and environmental safety. The lumen output intensity (i.e. brightness) of the LED approximately varies in direct proportion to the current flowing through the LED. Thus, increasing current supplied to an LED increases the intensity of the LED and decreasing current supplied to the LED dims the LED. The current may be modified by either directly reducing the direct current level to the LEDs or by reducing the average current through duty cycle modulation. For power supply applications, such as a battery charger or light emitting diode (LED) ballast, the power supply should provide a constant current. If load resistance is above this value, the output voltage needs to be constant.

Various types of conventional driver circuits that regulate the primary side current are known in the prior art. The U.S. Pat. No. 7,525,259 B2 describes a primary side regulated power supply system with constant current output. The claimed power supply system has a primary side and a secondary side. An input terminal on the primary side is operable to receive an input voltage. An output terminal on the secondary side is operable to be connected to a load for providing current thereto. Circuitry is provided which is operable to regulate the power supply system from the primary side so that the current provided to the load at the output terminal is substantially constant.

The U.S. Pat. No. 9,083,252 B2 describes the primary-side regulation for isolated power supplies. The claimed DC-DC converter includes a primary side sense circuit to detect a load current of the DC-DC converter based on reflected current from a secondary winding of the DC-DC converter to a primary winding of the DC-DC converter. A primary side diode models effects of a secondary side diode that is driven from the secondary winding of the DC-DC converter. An output correction circuit controls a switching waveform to the primary winding of the DC-DC converter based on feedback from the primary side sense circuit and the primary side diode.

However, in the claimed systems, the secondary side current consumption information is galvanically isolated. Typically, the secondary side currents are regulated though the information provided to primary side by a link such as an opto-coupler. The use of an opto-coupler is an expensive approach and provides a weak link in the system to achieve accurate primary side regulation (PSR) in LED applications.

Typically, the conventional system uses an explicit Low pass filter (LPF) to correct the Peak Regulation Voltage (PRV) at the end of a half cycle for inherent filtering. Typically, the PRVs are corrected at multiple points within a half cycle using high correction frequency. The increase in correction frequency susceptible to high frequency errors or noises and needs adequate filtering in LED applications.

Hence, there is need for a system to achieve accurate primary side regulation. (PSR), Power Factor Correction (PFC), dimming functionality without the need of external components. Further, the method corrects the PRV of primary loop to meet desired half cycle reference voltage or current, which in turn achieves the desired secondary loop currents in LED circuit using a firmware.

SUMMARY OF THE INVENTION

The present invention overcomes the drawbacks in the prior art and provides a system and method to regulate primary side current using an event driven architecture in LED circuit. The system comprises of an input module, a computing module, a subtractor module, a gain module, an accumulator module, an analog to digital module, a multiplier module, a digital to analog module, a Pulse Width Modulation (PWM) module, the power and current estimator module and a control module. The input module allows the user (s) to enter the desired reference voltage as per the requirement through a reference block. The computing module is configured to compute the average half cycle power or current from an input supply line cycle to generate the average feedback half cycle Peak Regulation Voltage (PRV) using an average filter. The subtractor module is configured to receive the desired reference voltage and the average feedback half cycle PRV or current from the input module and computing module. In the preferred embodiment, the received desired reference voltage and average feedback half cycle PRV or current is calculated by calculating the difference therein to produce an error signal using a subtractor. The gain module receives the difference error signal from the subtractor module and boost up the loop response and speed of error correction in the error signal by adding the gain signal. The accumulator module is configured to accumulate the error signal from the gain module and determine the level of effective reference set point signal to ensure the average feedback half cycle PRV equaling to the desired reference voltage using an accumulator. The Analog to Digital Converter (ADC) module is configured to regulate and convert the primary peak voltage to the digital signal to realize the wave shaping using an Analog to Digital Converter (ADC). The multiplier module multiplies the output of the analog to digital module and the accumulator module using a multiplier. The multiplier module contains information of the primary peak voltage and level of error signal. The Digital to Analog converter (DAC) module receives and converts the digital signal from the multiplier module to the analog signal using a Digital to Analog Converter (DAC). The DAC establishes the desired set voltage by regulating the primary peak voltage of the analog signal. The control module is configured to control the secondary side LED currents by regulating the primary peak voltage using a switch. The controlled secondary side currents are allowed to flow through a sense resistor to generate a voltage, wherein the generated voltage is in form of saw tooth waveform. The saw tooth waveform enables the user (s) to determine and calculate the turn ON time and turn OFF time of the switch to achieve regulation of secondary side currents by controlling the primary side currents.

In a preferred embodiment of the invention, the system further comprises of a Pulse Width Modulation (PWM) module to turn ON the switch when the output of the DAC is larger than the voltage from the sense resistor using a PWM converter.

In a preferred embodiment of the invention, the system further comprises of a power and current estimator module which is configured to determine the cycle by cycle power or current based on various factors such as the DAC set point, turn ON time of the switch and switching period of the switch.

In a preferred embodiment of the invention, the power and current estimator module further configured to determine the cycle by cycle power or current for both isolated system and non isolated system.

In a preferred embodiment of the invention, the system further comprises of a dim block, a thermal block and an input block, The dim block estimates the dimming duty cycle i.e. ON time and OFF time in the saw tooth waveform and in supply line frequency. The thermal block gives the thermal information of the outside electronic components such as LEDs and chips. The input block gives additional inputs to the system such as error correction or any other desired information as per the applications in the LED circuits.

In the preferred embodiment, the system further provides an offset error correction that may be added to the control loop to account for transformer ratio errors, inductor zero current errors and non linearity errors to improve the secondary side currents by controlling the primary side currents.

In the preferred embodiment, the system comprising a firmware module which is configured to work for each block to generate the response for one or more events and transmit the response via the event based module to operate at-least one of the block selected from the list of input module, the computing module, the suhtractor module, the gain module, the accumulator module, the ADC module, the multiplier module, the DAC module, the power and current estimator module, PWM converter module and the control module for LED applications.

According to another embodiment of the invention, the invention provides a method for regulating the primary side current using an event driven architecture in LED circuit. In most preferred embodiment, the method includes the step of triggering a switch by applying an analog signal to the gate terminal of the switch using a DAC. After triggering the switch, the time duration is calculated for the primary and secondary currents for each current cycle. After calculating the time duration, the area cycle of the primary and secondary currents are manipulated that are fed into the LED applications. Further, the manipulations are repeated for each area cycle in the waveform. Finally, the total average current is computed by taking the summation of area cycle (s) of the secondary currents divided by summation of time taken for each cycle (s).

In the preferred embodiment of the invention, the method further resets filter average currents when there is interruption using a firmware.

The present invention provides a system and method which is simple, time saving, resource efficient, and cost effective. The invention may be used in variety of applications as indicator lamps and in different types of lighting environments which uses LED's.

It is to be understood that both the foregoing general description and the following details description are exemplary and explanatory and are intended to provide further explanation of the invention as claimed.

BRIEF DESCRIPTION OF THE DRAWINGS

The foregoing and other features of embodiments will become more apparent from the following detailed description of embodiments when read in conjunction with the accompanying drawings. In the drawings, like reference numerals refer to like elements.

DETAILED DESCRIPTION OF THE INVENTION

Reference will now be made in detail to the description of the present subject matter, one or more examples of which are shown in figures. Each embodiment is provided to explain the subject matter and not a limitation. These embodiments are described in sufficient detail to enable a person skilled in the art to practice the invention, and it is to be understood that other embodiments may be utilized and that logical, physical, and other changes may be made within the scope of the embodiments. The following detailed description is, therefore, not be taken as limiting the scope of the invention, but instead the invention is to be defined by the appended claims.

The present invention discloses a system and method to regulate primary side current using an event driven architecture in LED circuit. The system (100) performs a primary side regulation (PSR) of isolated or non-isolated LED driver topology such as fly back system. The primary side peak voltage or current is regulated to achieve desired secondary side currents without the need of additional external components. The architecture combines firmware and hardware to realize PSR. The method (200) may effectively combine input wave shaping (Active PFC), dimming and PSR to achieve accurate secondary side currents. The method (200) corrects the Peak Regulation Voltage or current (PRV) of primary loop to meet desired half cycle reference voltage, which in turn achieves the desired secondary loop currents in LED circuit.

The present invention provides a system and method which is simple, time saving, resource efficient, and cost effective. The invention may be used in variety of applications as indicator lamps and in different types of lighting environments which uses LED's (120).

Figure 1:
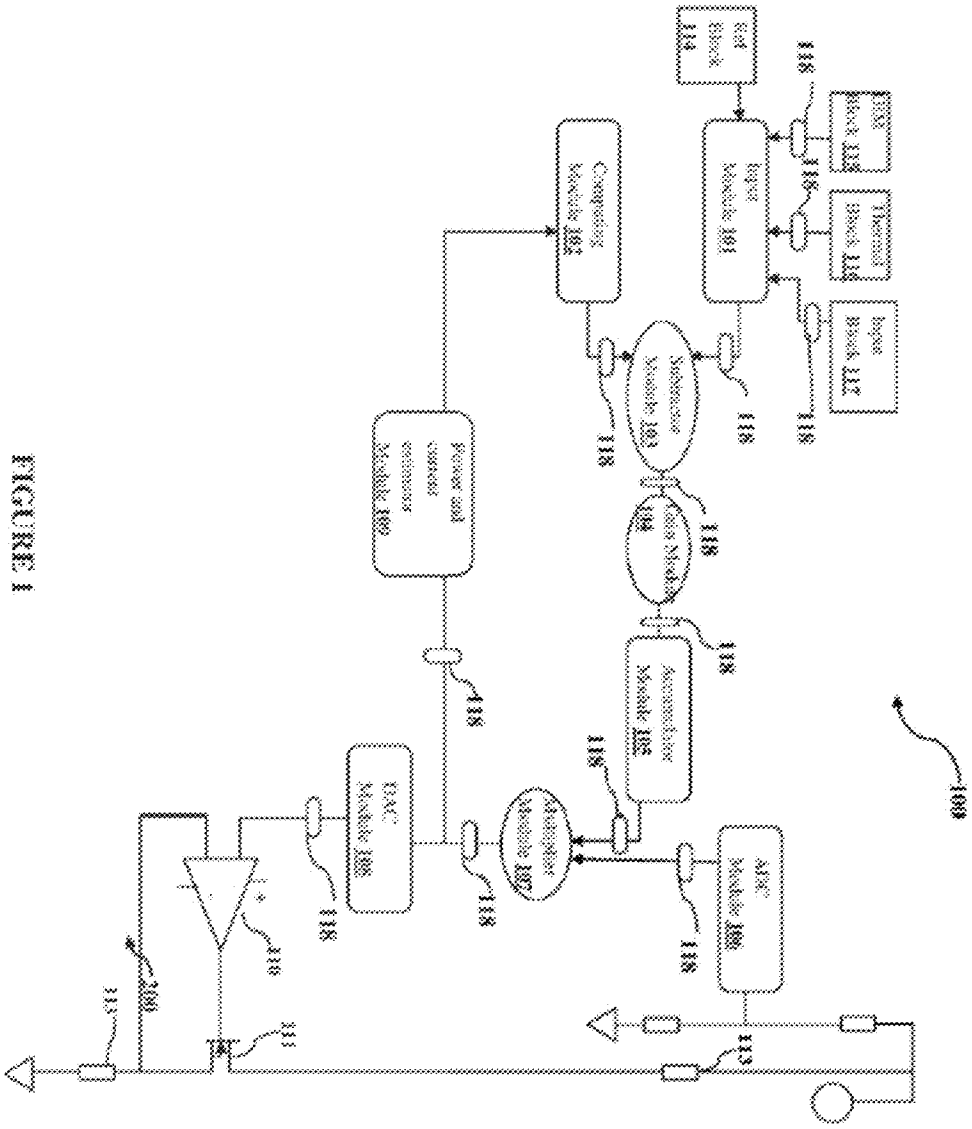
FIG. 1 illustrates a system to regulate primary side current using an event driven architecture in LED circuit, according to one embodiment of the invention.

FIG. 1 illustrates a system to regulate primary side current using an event driven architecture in LED circuit, according to one embodiment of the invention. In the most preferred embodiment, the system (100) comprises of an input module (101), a computing module (102), a subtractor module (103), a gain module (104), an accumulator module (105), an analog to digital module (106), a multiplier module (107), a digital to analog module (108), a Pulse Width Modulation (PWM) module (110), the power and current estimator module (109) and a control module. The input module (101) allows the user (s) to enter the desired reference voltage as per the requirement through a reference block (114). The computing module (102) is configured to compute the average half cycle power or current from an input supply line cycle to generate the average feedback half cycle Peak Regulation Voltage (PRV) using an average filter. The subtractor module (103) is configured to receive the desired reference voltage or current and the average feedback half cycle PRV from the input module (101) and computing module (102). In the preferred embodiment, the desired reference voltage and average feedback half cycle PRV is calculated by calculating the difference therein to produce an error signal using a subtractor. The gain module (104) receives the difference error signal from the subtractor module (103) and boost up the loop response and speed of error correction in the error signal by adding the gain signal. The accumulator module (105) is configured to accumulate the error signal from the gain module (104) and determine the level of effective reference set point signal to ensure the average feedback half cycle PRV equaling to the desired reference voltage using an accumulator. The Analog to Digital Converter (ADC) module (106) is configured to regulate and convert the primary peak voltage to the digital signal to realize the wave shaping using an Analog to Digital Converter (ADC). The multiplier module (107) multiplies the output of the analog to digital module and the accumulator module using a multiplier. The multiplier module (107) contains information of the primary peak voltage or current and level of error signal. The Digital to Analog converter (DAC) module (108) receives and converts the digital signal from the multiplier module to the analog signal using a Digital to Analog Converter (DAC). The DAC establishes the desired set voltage or current by regulating the primary peak voltage or current of the analog signal. The control module is configured to control the secondary side LED currents by regulating the primary peak voltage or current using a switch (111). The controlled secondary side currents is allowed to flow through a sense resistor (113) to generate a voltage, wherein the generated voltage is in form of saw tooth waveform. The saw tooth waveform enables the user (s) determine and calculate the turn ON time and turn OFF time of the switch to achieve regulation of secondary side currents by controlling the primary side currents.

In the preferred embodiment, the firmware module (118) is configured to operate for each module. The firmware module (118) provides flexible operations for each module. The connection between each block in the system is done through the firmware module (118). The firmware module (118) provides wireless connection between each block in the system. The operation of each block remains same even though the position of each block is interchanged using the firmware module (118).

In the preferred embodiment, the system having the power and current estimator module (109) is configured to determine the cycle by cycle power or current based on various factors such as the DAC set point, turn ON time of the switch and switching period of the switch. Further, the power and current estimator module (109) is configured to determine the cycle by cycle power or current for both isolated system and non isolated system.

The system (100) further comprises of a dim block, a thermal block and an input block. The dim block (115), the thermal block (116) and the input block (117) updates and alerts the system (100) by inputting the various information. The dim block (115) estimates the dimming duty cycle i.e. ON time and OFF time in the saw tooth waveform and in the supply line frequency. The thermal block (116) gives the thermal information of the outside electronic components such as LEDs and chips. The input block (117) gives additional inputs to the system such as error correction or any other desired information as per the applications in the LED circuits.

In the preferred embodiment, the system (100) further provides an offset error correction that may be added to the control loop to account for transformer ratio errors, inductor zero current errors and other non linearity errors to improve the secondary side currents by controlling the primary sided currents.

In the preferred embodiment, the system (100) comprising a firmware module (118) which is configured to work for each block to generate the response for one or more events and transmit the response via the event based module to operate at-least one of the block selected from the list of the input module (101), the computing module (102), the subtractor module (103), the gain module (104), the accumulator module (105), the ADC module (106), the multiplier module (107), the DAC module (107), power and current estimator module (109), PWM converter module (110) and the control module for LED applications.

Figure 2:
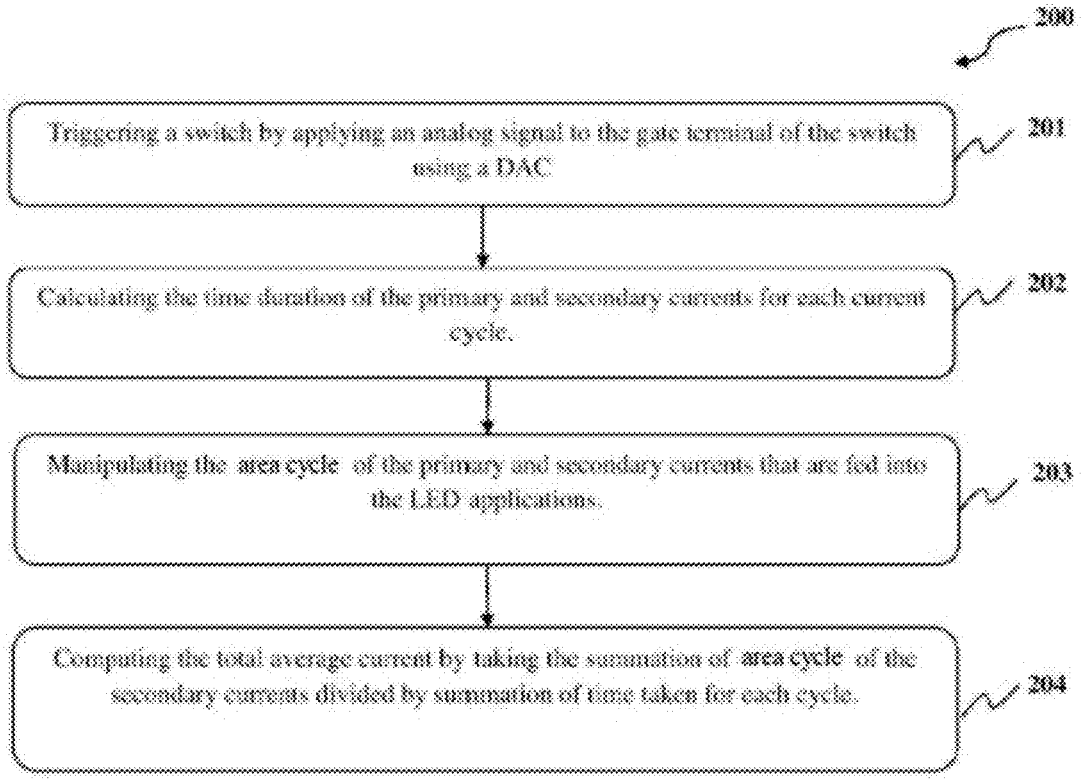
FIG. 2 illustrates the method for regulating the primary side current using an event driven architecture in LED circuit, according to one embodiment of the invention.

FIG. 2 illustrates the method for regulating the primary side current using an event driven architecture in LED circuit, according to one embodiment of the invention. In the preferred embodiment, at step (201), a switch is triggered by applying an analog signal to the gate terminal of the switch using a DAC. After triggering the switch, at step (202), the time duration is calculated for the primary and secondary currents for each current cycle. After calculating the time duration, at step (203), the area cycle of the primary and secondary currents are manipulating that are fed into the LED applications. In the preferred embodiment, the manipulations are repeated for each area cycle (s) in the waveform. Finally, at step (204), the total average current is computed by taking the summation of area cycle (s) of secondary currents divided by summation of time taken for each cycle (s).

In the preferred embodiment, method achieves the accurate primary side regulation (PSR), Power Factor Correction (PFC), dimming functionality without the need of external components. The method regulates secondary loop currents by controlling the. PRV or currents of primary loop in LED circuit using the below equations:

$$\text{Error}=V\text{set}-\{\Sigma[V\text{cycle peak}*(T\text{cycle}-\text{TON})*0.5]\}/(m*\Sigma\text{cycle})$$

Where, Vset=Reference set voltage
Vcyclepeak=Set point for peak cycle
Tcycle=Switching cycle period
TON=Primary coil ON time
m=number of supply half cycles $$\text{Effective Set Voltage}=\text{Error}*\text{Gain}$$

Where, gain is the system response used to achieve the overall system error correction gain is realized in firm ware and is useful to cater system response for various operating conditions $$\text{Average LED Secondary Currents}=V\text{set}/R\text{sense}*n$$

Where,

Vset=Specified reference voltage constant n=Transformer ratio

Rsense=Variable & is used to set the LED currents

Figure 3:
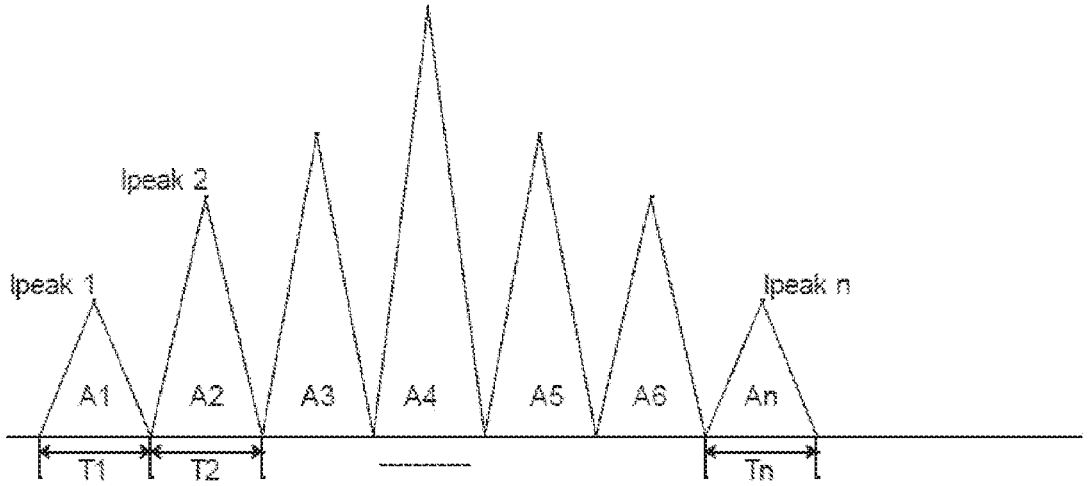
FIG. 3 shows the saw tooth waveform illustrating the average feedback primary side current in the LED circuit, according to one embodiment of the invention.

FIG. 3 shows the saw tooth waveform illustrating the average feedback primary side current in the led circuit, according to one embodiment of the invention. In the preferred embodiment, the saw tooth waveform indicates the cycle by cycle current limit and regulation details. The saw tooth waveform is used to calculate the average LED current. The average LED current for each cycle is calculated using the below equation:

$$\text{Average LED current}=(A1+A2+A3+A4+\ldots+An)/(T1+T2+\ldots+Tn)$$

$$Ax=(I\text{peak}x)=(Tx/2)$$

Where, Ax indicates the averaged primary side current.

Figure 4A:
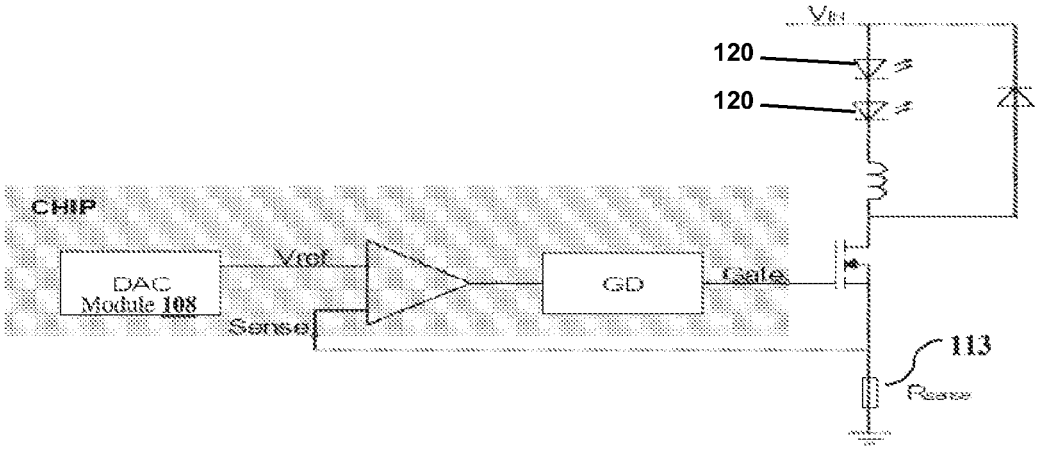
FIG. 4*b* shows the waveforms of non-isolated system in the LED circuit, according to one embodiment of the invention.

Tx indicates the time in each switch cycle for secondary currents,

FIG. 4*a* shows the block diagram of the non-isolated system in the led circuit, according to one embodiment of the invention. In the preferred embodiment, the primary side and the secondary side of the transformer are not isolated i.e. they are connected together. Here, the DAC module (108) establishes the desired set voltage or current by regulating the primary and secondary peak voltages or currents of the analog signal. The controlled primary and secondary side currents are allowed to flow through a sense resistor (113) to generate a voltage, wherein the generated voltage is in form of saw tooth waveform. The saw tooth waveform enables the user (s) determine and calculate the turn ON time and turn OFF time of the switch to achieve regulation of secondary side currents by controlling the primary side currents. In the preferred embodiment, the non-isolated system regulates to ensure that the average inductor current is equal to average load current to determine charge current (Q=IT), whereas in conventional buck-boost transformers, the average inductor current is not be equal to average load current, wherein such conventional systems may be realized using the firmware module in the invented system.

Figure 4B:
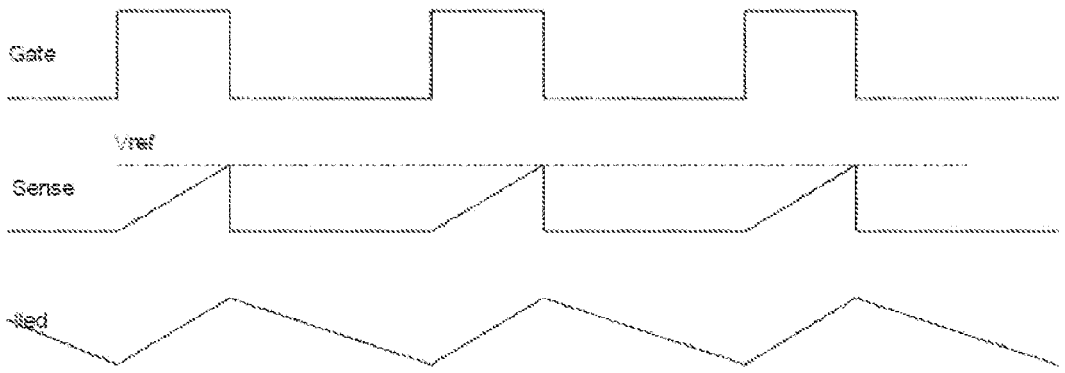

FIG. 4*b* shows the waveforms of non-isolated system in the led circuit, according to one embodiment of the invention. In the preferred embodiment, the primary and secondary side currents for each cycle(s) are calculated using the below equations:

$$V\text{ref}/R\text{sense}=(\text{Sense(peak)})/R\text{sense}$$

$$I\text{led(peak)}=V\text{ref}/R\text{sense}$$

$$\text{Average_Led_Currents}=I\text{led(peak)}/2$$

Figure 5A:
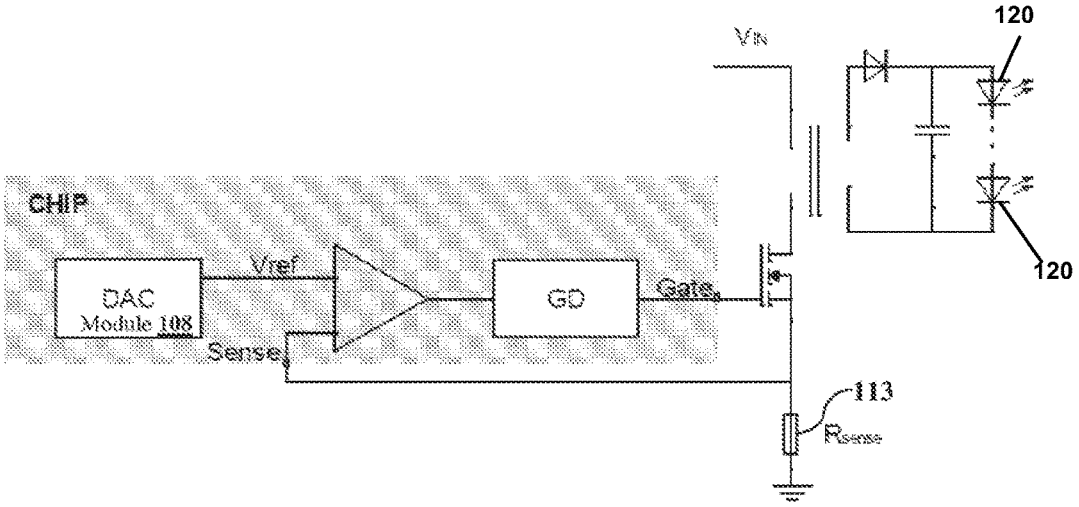
FIG. 5*a* shows the block diagram of the isolated system in the LED circuit, according to one embodiment of the invention.

FIG. 5*a* shows the block diagram of the isolated system in the led circuit, according to one embodiment of the invention. In the preferred embodiment, the primary side and the secondary side of the transformer are isolated i.e. they are not connected together. Here, the DAC module (108) establishes the desired set voltage by regulating the primary peak voltage of the analog signal, which in turn the secondary peak voltage. The controlled primary and secondary side currents are allowed to flow through a sense resistor (113) to generate a voltage, wherein the generated voltage is in form of saw tooth waveform. The saw tooth waveform enables the user (s) determine and calculate the turn ON time and turn OFF time of the switch to achieve regulation of primary and secondary side currents. In the referred embodiment, the isolated system regulates to ensure that the average inductor current is equal to average load current to determine charge current (Q=IT), whereas in conventional buck-boost transformers the average inductor current is not be equal to average load current.

Figure 5B:
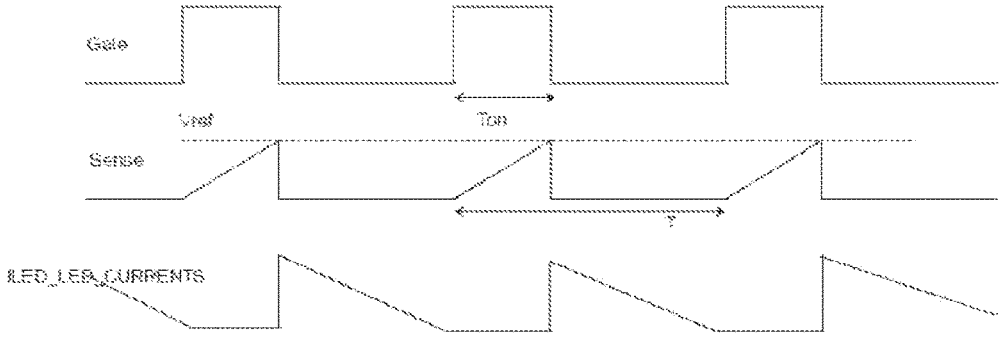
FIG. 5*b* shows the waveforms of non-isolated system in the LED circuit, according to one embodiment of the invention.

FIG. 5*b* shows the waveforms of non-isolated system in the led circuit, according to one embodiment of the invention. In the preferred embodiment, the primary and secondary side currents for each cycle are calculated using the below equations:

$$V\text{ref}/R\text{sense}=\text{Sense(peak)}R\text{sense}$$

$$I\text{nd(peak)}=V\text{ref}/R\text{sense}$$

$$\text{Average_Led_Currents}=I\text{nd(peak)}*1/2,\ \text{where}\ D=\text{Ton}/T$$

The present invention provides a system and method which is simple, time saving, resource efficient, and cost effective. The invention may be used in variety of applications as indicator lamps and in different types of lighting environments uses LED's.

It is to be understood, however, that eventhough numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

We claim:

1. A system to regulate a primary side current using an event driven architecture in an LED circuit, the system comprising:

an input module configured to enable a user to enter a reference voltage set point through a reference block;

a computing module configured to compute an average half cycle power or current from an input supply line cycle comprising one or more cycles to generate an average feedback half cycle Peak Regulation Voltage (PRV), wherein the average half cycle power or current is an average power or current of half of the one or more cycles and the average feedback half cycle PRV is an average PRV for half of the one or more cycles generated by the computing module using an average filter;

a subtractor module configured to receive the reference voltage set point and the average feedback half cycle PRV from the input module and the computing module and to subtract a difference between the reference voltage set point and the average feedback half cycle PRV to produce an error signal;

a gain module configured to receive the error signal from the subtractor module and to boost up the error signal by adding a gain signal;

an accumulator module configured to accumulate the boosted error signal from the gain module, the accumulator module determines a level of effective reference set point signal to ensure the average feedback half cycle PRV equaling to the reference voltage set point;

an analog to digital converter (ADC) module configured to regulate and convert a primary peak voltage or current to an output digital signal;

a multiplier module configured to multiply the output digital signal of the ADC module;

a digital to analog converter (DAC) module configured to receive and convert the multiplied output digital signal from the multiplier module to an output analog signal, wherein the DAC module establishes a desired set voltage or current by regulating the output analog signal; and a control module configured to control a secondary side current by regulating the primary peak voltage or current using a switch, wherein the controlled secondary side current is allowed to flow through a sense resistor to generate a voltage, wherein the generated voltage is in form of a saw tooth waveform, wherein the saw tooth waveform enables the user to determine and calculate a turn ON time and a turn OFF time of the switch.

2. The system of claim 1, further comprising:

a Pulse Width Modulation (PWM) module, wherein the PWM module is configured to turn ON the switch when the output analog signal of the DAC module is larger than the generated voltage from the sense resistor.

3. The system of claim 1, further comprising:

a power and current estimator module configured to estimate and determine power and current of each of the one or more cycles based on various factors including a DAC set point, the turn ON time of the switch, and a switching period of the switch.

4. The system of claim 3, wherein the power and current estimator module is further configured to determine the power and current of each of the one or more cycles for both an isolated system in which the primary side current and the secondary side current are not connected together and a non-isolated system in which the primary side current and the secondary side current are connected together.

5. The system of claim 4, wherein the system further realizes a transfer function to regulate outputs in both the isolated and the non-isolated system using a firmware module.

6. The system of claim 1, further comprising:

a dim block, a thermal block, and an input block, wherein the dim block is configured to estimate a dimming duty cycle, and wherein the dimming duty cycle is estimated by the dim block based on the turn ON time and the turn OFF time of the switch.

7. The system of claim 1, further comprising:

a transformer in the LED circuit, wherein the system further provides an offset error correction to account for errors that are generated by the transformer.

8. A method to regulate a primary side current using an event driven architecture in an LED circuit, the method comprising:

triggering a switch by applying an analog signal to a gate terminal of the switch using a digital to analog converter (DAC);

calculating a time duration of the primary side current and a secondary side current for each of one or more current cycles;

manipulating area cycles of the primary side current and the secondary side current, wherein each area cycle is an area under each waveform cycle of the one or more current cycles; and computing a total average current by taking a summation of area cycles of each of the one or more current cycles divided by a summation of time taken for each of the one or more current cycles.

9. The method of claim 8, further comprising:

calculating an area of current through at least two parameters selected from a list of a turn ON time of a switch, a turn OFF time of the switch, a total time of the turn ON time, and the turn OFF time during a switching operation of the switch, wherein the turn OFF time in the secondary side current is calculated by using the turn ON time and the total time of the turn ON time and the turn OFF time.

10. A system to regulate a primary side current in an LED circuit, the system comprising:

an input module configured to input a reference voltage set point;

a computing module configured to compute an average half cycle current from an input cycle comprising one or more cycles to generate an average feedback half cycle Peak Regulation Voltage (PRV), wherein the average half cycle current is an average current of half of the one or more cycles and the average half cycle PRV is an average PRV for half of the one or more cycles generated by the computing module;

a subtractor module configured to subtract a difference between the reference voltage set point and the average feedback half cycle PRV to produce an error signal;

an accumulator module configured to determine a level of effective reference set point signal based on the error signal;

an analog to digital converter (ADC) module configured to convert a primary peak voltage or current to an output digital signal;

a digital to analog converter (DAC) module configured to receive and convert the output digital signal to an output analog signal, wherein the DAC module establishes a desired set voltage or current by regulating the output analog signal; and a control module configured to control a secondary side current by regulating the primary peak voltage or current.

* * * * *